US005201697A

United States Patent [19]

Capy

[11] Patent Number: 5,201,697

[45] Date of Patent: Apr. 13, 1993

[54] PROCESS AND APPARATUS FOR MAKING A WRAPPING FROM A THIN PLEATED SHEET

[75] Inventor: Gilbert Capy, La Botte 69640, Jarnioux, France

[73] Assignees: Gilbert Capy; Akiva Buchberg, Paris, France

[21] Appl. No.: 752,866

[22] Filed: Aug. 30, 1991

[30] Foreign Application Priority Data

May 29, 1991 [FR] France ..... 90 12267

[51] Int. Cl.[5] ..... B31B 5/60; B65D 65/08

[52] U.S. Cl. ..... 493/22; 493/28; 493/341; 493/357; 493/394

[58] Field of Search ..... 493/22, 23, 28, 341, 493/357, 394, 413, 414, 439, 463, 941

[56] References Cited

U.S. PATENT DOCUMENTS

| | | | |
|---|---|---|---|
| 2,098,427 | 11/1937 | Menscher | 493/412 |
| 2,429,482 | 10/1947 | Munters | 154/30 |
| 3,947,206 | 10/1974 | De Ligt et al. | 425/388 |
| 3,991,994 | 11/1976 | Farish | 493/430 |
| 3,998,140 | 12/1976 | Andre | 493/941 |
| 4,153,664 | 5/1979 | Sabee | 264/289 |
| 4,340,212 | 7/1982 | Simson | 493/439 |
| 4,597,748 | 7/1986 | Wolf | 493/29 |
| 4,717,372 | 1/1988 | Herrington | 493/394 |
| 4,795,648 | 1/1989 | Capy et al. | 426/111 |
| 5,071,555 | 12/1991 | Enbom | 210/493.5 |

FOREIGN PATENT DOCUMENTS

| | | |
|---|---|---|
| 482701 | 5/1948 | Belgium . |
| 1460606 | 2/1969 | Fed. Rep. of Germany . |
| 1571358 | 7/1980 | United Kingdom . |

*Primary Examiner*—William E. Terrell

*Attorney, Agent, or Firm*—Kane, Dalsimer, Sullivan, Kurucz, Levy and Eisele

[57] ABSTRACT

Wrappings from thin pleated sheets are made from a continuous thin paper tape and the like by first making transversal folds in the tapes to form pleats, fixing the edges of the pleats and then folding the fixed edges to form hems. The hemmed pleated tape may then be cut into individual wrappings. The paper tape is coated with heat-setting material so that the pleats can be fixed by melting and resetting this material.

19 Claims, 3 Drawing Sheets

PROCESS AND APPARATUS FOR MAKING A WRAPPING FROM A THIN PLEATED SHEET

BACKGROUND OF THE INVENTION

A. Field of Invention

This invention pertains to a process and apparatus for making a wrapping from an endless sheet including the step of pleating the sheet.

B. Description of the Prior Art

As described in French Patent FR 2,595,666-B1 and French Patent of Addition FR 2,628,719, as well as U.S. Pat. No. 4,795,648, a wrapping made of a single thin sheet may be made, for example, for hamburgers as well as other objects having a general convex shape. This wrapping is made, for example, of a single thin sheet of paper which is flexible, or a more complex material or sheet which has a thin piece of paper as a base. The sheet is first formed into a generally elongated rectangular shape which is then pleated with knife pleats extending in parallel to the width of the sheet. Thereafter, the pleats are fixed at their borders in such a manner that the pleats can be opened or deployed only at their central region. There are a large number of methods or means by which the pleats can be fixed including welding or using an adhesive medium. In one preferred version, a sheet of paper coated on one side with a heat weldable material on one surface is disposed on the end of the pleat for fixation. This weldable material is deposited on the paper in a thin layer, for example, by using an aqueous emulsion to deposit a film of plastic on the paper. The pleated sheet produced in this manner is advantageous in that it is easy to cut and resists peeling.

OBJECTIVES AND SUMMARY OF THE INVENTION

An objective of the present invention is to provide a method and apparatus for continuously pleating a paper tape.

A further objective is to provide a method and apparatus whereby a tape is pleated to form sections separated by unpleated regions whereby said unpleated regions can be separated to yield individual wrappings.

Yet another objective is to provide an apparatus which is efficient, and is easy to assemble and operate. Other objectives and advantages shall become apparent from the following description of the invention.

Briefly an apparatus constructed in accordance with this invention includes a first station wherein a continuous tape is pleated by folding the tape transversally and then pressing the folds. The pleats are then temporarily fixed at the edges and transferred to a second station for final fixation. The final fixation of the pleats is accomplished by folding the pleats over to form a hem. Thereafter, the continuous pleated tape is separated into individual wrappings.

A BRIEF DESCRIPTION OF THE FIGURES

DETAILED DESCRIPTION OF THE INVENTION

Figure 1:
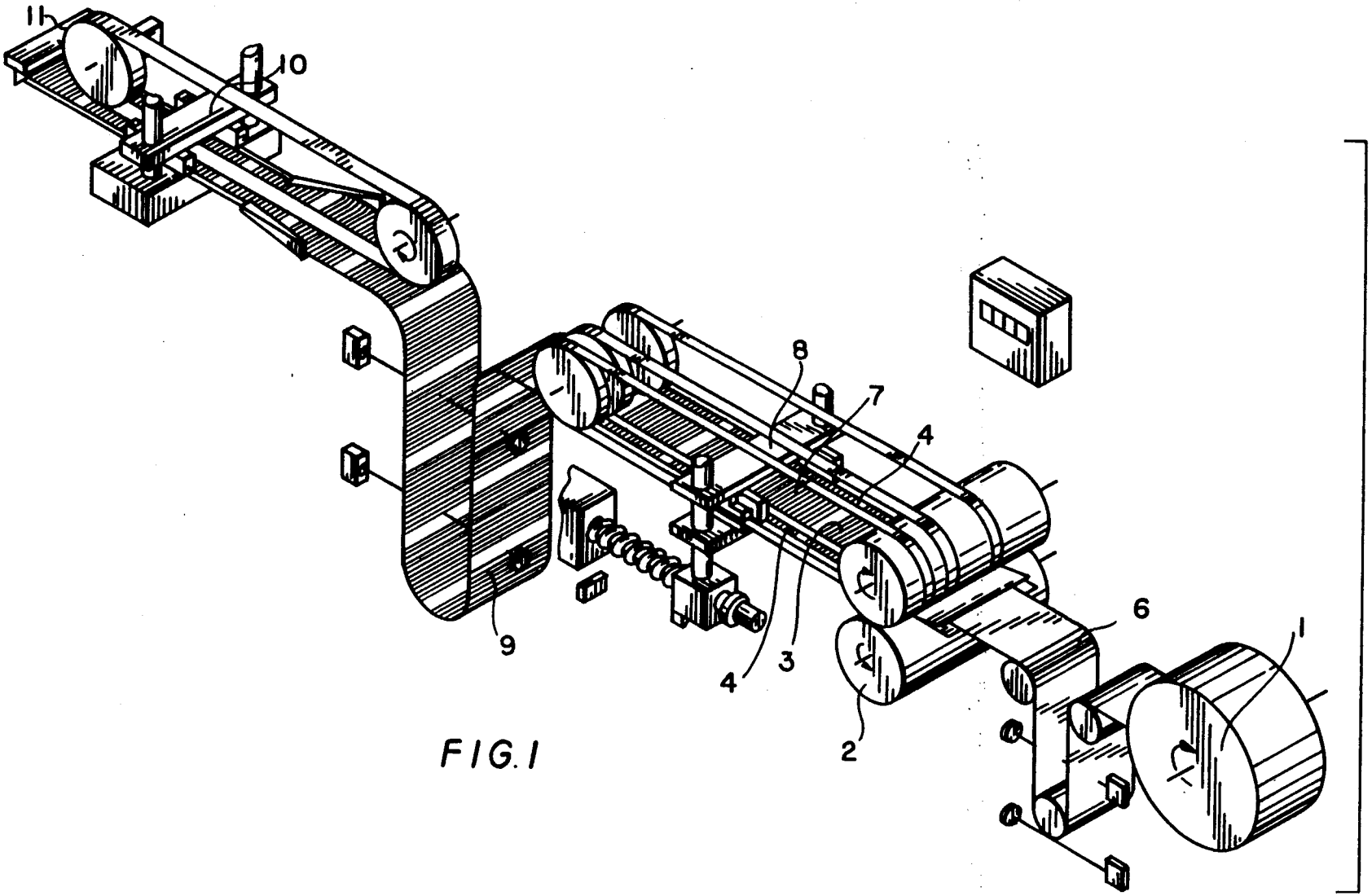
FIG. 1 shows an orthogonal view of an apparatus constructed in accordance with this invention.

The subject apparatus can be used for pleating various types of thin foils which are relatively flexible and which are supplied on a roll. These foils may include various rubber-based materials as well as films made of plastic materials. For the sake of simplicity, in the following description, a sheet or tape made out of a paper base is assumed. In FIG. 1, a roll of paper 1, which may be imprinted, for example, with the logo of a customer and may be treated with various substances for example to resist impregnation by foreign materials such as fats. The roll of paper 1 has a width which is equal to the width of the pleated sheet to be formed by the apparatus. In order to fabricate several wrappings at once from a single sheet in a continuous manner, the process of fabrication must include a means of fixing the pleats and means of affixing bands at the two lateral sides of the wrapping.

The roll 1 is initially disposed on a shaft in such a manner so that it can pay off continuous paper tape 6 under a constant tension. Paper tape 6 is then fed into pleating apparatus which then forms transversal pleat 3 perpendicular to the borders 4 of the paper tape. After pleating, the pleated tape 7 passes to a first fixation station 8 where the pleats are temporarily fixed. Thereafter, the pleated tape is formed into an open loop 9 so that the first section described so far and the second section to be described hereinafter can be operated at different velocities.

In the second section, from loop 9, the pleated tape is introduced into a second fixation station 10 where final fixation occurs. From station 10, the pleated tape is passed on to station 11 where the pleated tape is separated into individual wrappings. The wrappings may be collected into stacks.

In one version of the invention, the paper tape is coated on one face 30 (see FIG. 2) with a thermal weldable film which allows the pleats to be fixed by the simple application of heat. However, the fixation of the pleats may also be accomplished by using various adhesives applied directly on the paper tape or by using bands which also serve as a means of reinforcing the paper.

Figure 2:
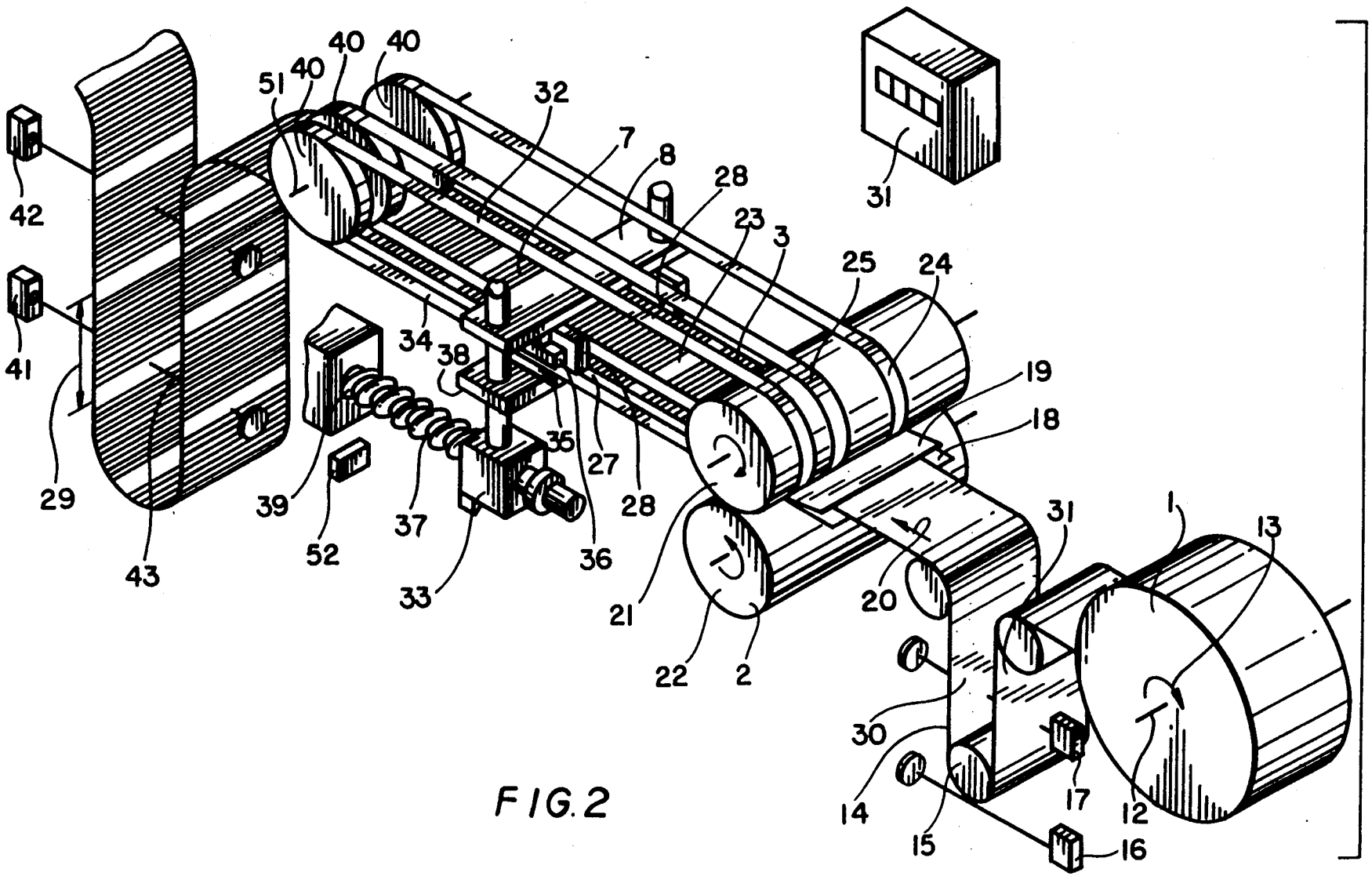
FIG. 2 shows a first section of the apparatus of FIG. 1.

Roll 1, (FIG. 2) is mounted on an axle 12 to form a system for paying off the paper tape 6 for delivery at a tension as constant as possible. This may be accomplished in a number of different ways well-known in the art. In FIG. 2, the system employed makes use of an axle 12 which is coupled to an electric motor through a speed reducer which turns the axle as indicated by arrow 13 in the direction so as to pay off paper tape from the roll. The direction of movement of the paper is evidently a function of rotation of the motor. If necessary, the paper can be rewound on roll 1 by reversing the motor. (The motor and the speed reducer have been omitted for the sake of priority.) From roll 1, the paper tape 6 is formed into a loop 14 by a cylinder 15. Cylinder 15 is free to ride up and down to control the tension of the paper 6 whereby the weight of the cylinder 15 defines the tension of tape 6. The movement of cylinder 15 can be controlled by using vertical guides which have been omitted for the sake of clarity. The top and bottom positions of the cylinder 15, and therefore the length of loop 14, are controlled by two electric eyes 16 and 17 which are used to turn on and off the electric motor driving roll 1, as required. From loop 14, the paper tape 6 is passed to the pleating station 2.

At the pleating station, paper tape 6 passes over and is supported by a flat plate 18. A second plate disposed at an angle with plate 18 is reciprocated in a translational motion in parallel to the plane of plate 18. The means of reciprocating plate 19 have been omitted for the sake of clarity. Two rollers 21 and 22 are used to press to form a press nip. The plates 18 and 19 cooperate to feed the tape from loop 14 into this press nip. The two rollers rotate in opposite directions and they are operated either continuously or intermittently in conjunction with the movement of plate 19 as described below. More particularly, as plate 19 moves in direction 20, rollers 21 and 22 are either stationary or move at a very low velocity forcing the tape to accumulate just upstream of the press nip until a predetermined amount of tape is gathered between plate 18 and the press nip. As the plate 19 is then returned to its former position in the direction opposite arrow 20, the rollers 21 and 22 then force the tape to fold over itself and form a new pleat by pressing the folded tape through the press knit. The new pleats are indicated at 3 in FIG. 2.

Preferably, each wrapping formed by the subject apparatus consists of a plurality of pleats separated by unpleated regions. This is accomplished as follows. For each pleat 3 the rollers 21 and 22 turn for a fraction of their circumference. A counter 31 coupled to the rollers 21 or 22 for monitoring the formation of pleats is used to count the number of pleats 3. When a preset number of pleats has been formed, the rollers 21 and 22 are used to advance the tape 6 through the nip while the plate 19 is idle so that for a predetermined distance an unpleated area is defined as indicated by numeral 23. This unpleated region 23 is sufficiently wide so that adjacent wrappings can be separated from each other as described below.

The first section illustrated in FIG. 2 also includes a plurality of wheels 40 rotating around on axis 51. Axis 51 is disposed in parallel with the axis of rotation of roller 21, and carry a plurality of belts 24 and 25. These belts are driven by roller 21 and are used to translate the pleated tape 7. The actual number of belts to be used is determined by the width of the pleated tape 7. For a relatively narrow pleated tape 7, a single belt may be sufficient. These belts 24 and 25 push the tape 7 on top of a sliding plate (not shown). Along the sliding plate, there is a temporary fixation station 8. At this station, the pleats are temporarily affixed at the two margins of the tape to insure that they don't open during further processing. This temporary fixation can be accomplished in a number of different ways. In a preferred embodiment, a separate fixation band having adhesive either on one face or on both faces may be used. In another preferred embodiment of the invention, the fixation of the pleats may be accomplished by applying a coating of thermosetting plastic material to edges 4 of the pleated tape 7. Preferably in order to insure that the plastic material does not deposit on the components of the machinery, this material is applied to the bottom surface 31 of tape 7. Once the plastic material is deposited (by means not shown), the pleated tape 7 is then passed between two electrodes, a hot electrode 28 and a cold electrode 27. The hot electrode is disposed on top of the sheet, opposite the surface which has been coated. The bottom cold electrode 27 is coated with a non-sticking material, such as teflon. The thermo-setting plastic material may be, for example, a high pressure polyethylene or a hot melt material. Alternatively, the hot electrode may also be positioned to face the bottom surface of the paper and be coated with a non-sticking material. In some situations, for example when separate fixation bands are used, it may be necessary to apply a fixation medium to both surfaces of the tape in which case both electrodes 27 and 28 may be hot electrodes. The choice between one or two hot electrodes depends on the characteristics of the wrapping paper required. The hot electrode may be operated at a constant temperature or it may be heated and allowed to cool in a cyclical manner to melt the fixation medium as required. Preferably, the fixation medium is applied along borders 4 for a length equal to the length of the wrapping. The electrodes are translated along plate 34 at a speed equal to belts 24 and 25 for a time period sufficient to melt the fixation medium.

There are number of ways in which the speed of the pleated tape 7 and the electrodes 27 and 28 can be synchronized. In a preferred embodiment, a supplemental belt 32, disposed laterally to belts 24 and 25, is used to move a carriage 33. Carriage 33 is mounted on a horizontal guide 37 mounted on frame 39. Carriage 33 also includes two contact shoes 35 and 36 which selectively engage and disengage belt 34. The position of assembly is monitored by a proximity switch 52. The temporary fixation station operates as follows. When carriage 33 is disposed in the position shown in FIG. 2, the pleated portion of a wrapper is positioned between the electrodes 27 and 28 for temporary fixation. Advantageously, the length of the electrodes corresponds to the length of the wrapping 29 or at least the pleated section of the wrapping. In this position the contact shoes 35 and 36 move toward each other to grip and engage belt 34. Since the belt moves synchronously with the belts 24 and 25, the whole carriage 33 starts moving in direction 20 after contact shoes 35 and 36 grip the belt 34. The two electrodes 27 and 28 also close or come into contact with the pleated tape 7. Thus, the whole carriage 33 moves along direction 20 to apply direct heat to the fixation medium. Alternatively, depending on the fixation medium, instead of heat, a different means may be applied to activate the fixation medium such as application of a ultrasonic welding means. When the carriage 33 reaches proximity switch 52, the temporary fixation has been completed and the electrodes as well as the contact shoes 35, 36 separate thereby releasing the pleated tape 7 and belt 34 respectively. At this point, the carriage 33 is moved back to the position shown in FIG. 2. This may be accomplished by using a hydraulic or pneumatic cylinder, or by using a torsion spring mounted on rod 37 as shown.

Again, depending on the width of the final pleated wrapping, a single supplemental belt 32 may be used or, if necessary, more than one belt 32 may be used. Of course, the carriage 33 moves back at the same time as the unpleated region 23 is being formed thereby insuring that all the pleated sections are properly fixed. Preferably, a second carriage disposed on the other side of pleated tape 7 operates synchronously with carriage 33 to insure that the borders 4 are treated evenly. If necessary, counter 31 may be used as a means of activating or controlling the movement of carriage 33 to assure proper synchronization between the pleating action of the rollers 21, 22 and the operation of carriage 33.

It is evident that the height or spacing between electrodes 27 and 28 must be set to accept the pleated tape 7. In FIG. 2, electrodes 27 and 28 are reciprocated by carriage 33 however, they can also be fixed. As mentioned above, the electrodes are disposed above and below the tape, but in some occasions they may also be disposed adjacent to the tape. Since the pleats are maintained in position by belts 24 and 25, it is not necessary that electrodes 27 and 28 actually contact the pleated tape 7. Therefore, a simple hot electrode may also be used. Contacting electrodes are preferable for relatively thin materials.

In an alternative embodiment of the invention, instead of using a separate fixation zone for temporarily fixing the pleats, a plurality of wheels may be mounted on axis 51 (not shown for the sake of clarity) whose wheels form longitudinal grooves disposed along the edges of the pleat corresponding to the positions of the hems for the final fixation as described below. Of course, these grooved wheels for making grooves have the same diameter as the wheels 40 shown in FIG. 2.

After wheels 40, the pleated tape is formed into a second open loop 9 as shown in FIG. 2. In this loop, the pleats remain secured to each other because of the temporary fixation at zone 8. This loop 9 has a variable length regulated by a couple of photoelectric cells 41 and 42 which accelerate and decelerate the speed of operation of stations 10 and 11 and/or pleating station 2 as described below. This loop allows the whole apparatus to continue operating even if sections of the apparatus, for example downstream from loop 9, slow down. An advantage of using a wrapping having an unpleated region 23 is that it provides a zone which insures that there is a tolerance associated with the overall length 29 of each wrapping. This zone permits slight variation in the operation of pleating plate 19 or slippage between plate 19 and paper tape 6 during the formation of the pleats. Since a fixed number of pleats are formed for each set of wrappings, the variations in length 29 are compensated by the variation in the length of region 23.

Figure 3:
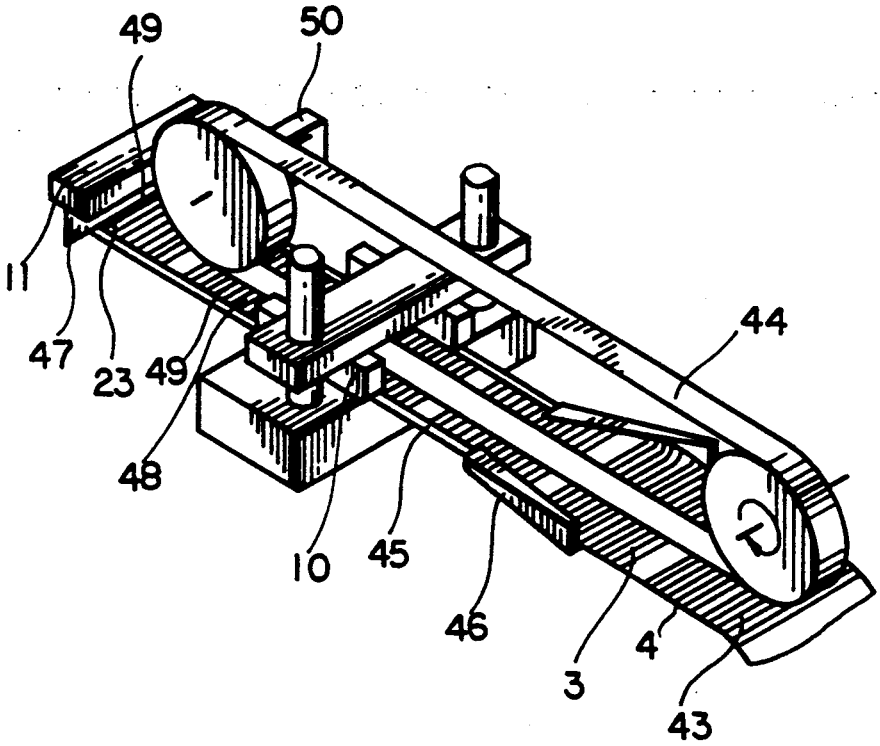
FIG. 3 shows a second section of the apparatus of FIG. 1.

As shown in FIG. 3, after loop 9 the band of pleated paper 43 is again entrained between a sliding plate disposed under the sheet and a rotating or moving belt 44 disposed on top of the sheet for permanently fixing the pleats at station 10. The organization of station 10 depends on the mode of permanent fixation of the pleats. One such structure is shown in the afore mentioned patents. Alternatively, a separate adhesive band may be unrolled and applied to the pleat borders, or a thin narrow sheet of paper coated with a thermo-setting, weldable material may be applied to the pleats for final fixation. In one embodiment of the invention, at station 8 (FIG. 1) a double-faced, adhesive band is secured to the pleats overlapping the pleats by a distance equal to the width of the adhesive tape. As shown in FIG. 3, a pair of channels 46 is used to turn borders 4 of the pleated tape over so that they are superimposed on top of the adhesive tape to form a hem 45. Thereafter, the creased border is pressed down by using standard rollers (not shown). In a preferred embodiment of the invention, instead of a separate tape, a thermo-settable or weldable material is coated directly on one surface 30 of sheet 6 as shown in FIG. 1. In this embodiment, the temporary fixation occurs by heating this material either by application of heat or through ultrasound. Then at the permanent fixation station 10, after the sheet has been folded to form hem 45 in FIG. 3, heat or ultrasound are applied at station 10 in order to insure that the folded-over band is firmly welded.

One skilled in the art will realize that because of the provision of loop 9, the production of pleated wrappings may be continuous because after the paper tape 6 has been pleated and temporarily fixed, it can be temporarily accumulated in loop 9.

The final fixation of the pleat occurs between a cold and a hot electrode in a manner similar to the one used at station 8 described above. Similarly as before, if necessary, both electrodes can be hot electrodes. Additionally, if necessary, the electrodes may be reciprocating.

Once the fixation is completed, the hem 45 is permanently fixed to the borders of the pleated sheet 48 and now the sheet 48 may be separated into individual wrappings. Preferably, this is done by first stopping the continuous pleated sheet 48 at station 11 prior to the separation. Separation takes place by using a knife 47 to cut zone 49, which zone does not have any pleats. Station 11, which separates the individual wrappings from the continuous sheet, must be synchronized with station 10. As the wrappings may have different lengths 29 as shown in FIG. 2 and discussed above, each wrapping must be individually stopped so that the zone 49 can be located on continuous band 48. Zone 49 can be detected in a number of different ways. In one embodiment of the invention, a cell 50 is used to emit a beam of light which traverses the sheet of paper 23. The amount of the light from cell 50 which is absorbed as opposed to the light passing through the sheet is a function of the number of layers of the sheets. In zone 49 where there are no pleats, a relatively small amount of the light absorbed while the pleated sections having several layers. Hence, cell 50 cooperates with the light sensor (not shown) used to determine the exact location of each unpleated region 49. This unpleated region is positioned next to blade 47 so that sequential wrappings can be cut off as required. As mentioned above, therein at station 10, the hem 45 must be welded to the pleated sheets. This can be accomplished if the sheet is relatively thin, merely by the application of heat. For thicker paper, more effective welding means may be used such as ultrasonic welding means. Ultrasonic welding is preferable for papers which contain or other sheets which may contain chlorine atoms such as PVC-based sheets.

Station 11 may be used as a feed point for an automatic apparatus which may be used for surrounding objects into individual wrapping just produced, or an apparatus for stacking the wrappings, and so on. For the sake of simplicity, blade 47 is shown as a relatively straight blade directed across sheet 23. However, the blade may have more complex shapes so that different cuts can be made. For example, the blade can be used to make straps in the wrapping which would be used to hold the wrapping around the object. For more complex shapes, instead of a straight blade, a cutting element may be used which may be mounted on a cylindrical surface.

In order to store the various wrappings after they have been cut out, a storage container may be positioned after station 11. Preferably, the storage container has a generally rectangular shape corresponding to the shape of the wrapping so that a large number of these wrappings can be stacked inside a container. For example, a container may be disposed under a horizontal slot disposed downstream of blade 47. After a particular wrapping has been cut, it then is automatically fed through the horizontal slot to fall into the container. Means may be provided for detecting when the container is full so that it can be replaced with an empty container.

Obviously numerous other modifications can be made to the invention without departing from its scope.

I claim:

1. A method of making a continuous tape separable into pleated wrappings, said method comprising the steps of:

providing an elongated tape having a longitudinal axis;

folding sections of said tape along fold lines transversal to said longitudinal axis to form pleats with end edges;

fixing said end edges by securing the end edge of one pleat to the end edge of an adjacent pleat to prevent separation of the pleats;

folding the fixed end edges to form pleats with hemmed edges;

fixing the hemmed edges by securing the hemmed edge of one pleat to the hemmed edge of an adjacent pleat; and separating the pleats into wrappings.

2. The method of claim 1 wherein said tape is coated with a weldable film and wherein said pleats are fixed by welding said edges.

3. The method of claim 1 wherein said pleats are separated by unpleated regions.

4. The method of claim 1 wherein said pleats are formed by folding preselected lengths of said tape transversely and pressing said folds in a press nip.

5. An apparatus for forming pleated wrappings comprising:

a source of tape for providing a continuous tape having a longitudinal axis;

a pleating station for forming transversal pleats by folding said continuous tape transversely to said longitudinal axis into folds and pressing said folds into said transversal pleats, said transversal pleats having pleat ends with hemmed edges, said pleating station including:

first fixation means for fixing adjacent pleats to form fixed pleats by securing edges of one pleat to edges of an adjacent pleat to prevent separation of the pleats;

hemming means for hemming said fixed pleats to form hemmed pleats by folding said fixed pleats along a longitudinal line parallel to said longitudinal axis; and second fixation means for fixing the hemmed pleats.

6. The apparatus of claim 5 wherein said source feeds said continuous tape in a preselected direction to said pleating station, and wherein said pleats are transversal to said preselected direction.

7. The apparatus of claim 5 wherein said tape is provided with a weldable material, and wherein said first fixation means includes setting means for setting said weldable material.

8. The apparatus of claim 7 wherein said setting means is stationary.

9. The apparatus of claim 7 wherein said setting means is reciprocating in a direction parallel to said tape.

10. The apparatus of claim 7 further comprising; loop means for forming a loop between said first and said second fixation means.

11. The apparatus of claim 5 wherein said pleating station includes a first plate holding said tape and a second plate reciprocating with respect to said first plate, said first and second plates cooperating to form said tape into said folds.

12. The apparatus of claim 11 wherein said pleating station includes a press means for forming a press nip for pressing said folds into said pleats.

13. The apparatus of claim 12 further comprising counting means for counting the number of pleats formed by said pleating means.

14. The apparatus of claim 5 further comprising counting means for counting the number of pleats formed by said pleating means.

15. The apparatus of claim 5 further comprising cutting means for cutting the pleated tape into individual wrappings.

16. An apparatus for forming pleats comprising:

a source of tape for providing an elongated continuous tape with a longitudinal axis;

a pleating station receiving said tape and folding transversal sections of said tape into folds perpendicular to said longitudinal axis and pressing said folds into pleats having pleat edges;

first transfer means for transferring pleated tape away from said pleating station;

first fixation means cooperating with said first transfer means for receiving said pleated tape and temporarily fixing the pleat edges of adjacent pleats to prevent the separation of pleats, to form fixed pleats;

hemming means for hemming said fixed pleats to form hemmed pleats by folding said pleats along lines parallel to said longitudinal axis;

second fixing means for permanently fixing said hemmed pleats along said tape; and loop means disposed between said first and second fixation means for forming a loop of said pleated tape.

17. The apparatus of claim 16 wherein further comprising second transfer means for transferring the pleated tape to said second fixation means.

18. The apparatus of claim 17 wherein said first and second fixation means comprises belts and belt drive means.

19. The apparatus of claim 16 further comprising cutting means for cutting the pleated hemmed tape into individual wrappings.

* * * * *